US006769994B2

(12) United States Patent
Boone

(10) Patent No.: US 6,769,994 B2
(45) Date of Patent: Aug. 3, 2004

(54) SHOT CONTROL HOSEL

(75) Inventor: David D. Boone, Lake Forest, CA (US)

(73) Assignee: Golfsmith Licensing, LLC, Austin, TX (US)

( * ) Notice: Subject to any disclaimer, the term of this patent is extended or adjusted under 35 U.S.C. 154(b) by 0 days.

(21) Appl. No.: 10/117,426

(22) Filed: Apr. 5, 2002

(65) Prior Publication Data

US 2004/0063515 A1 Apr. 1, 2004

Related U.S. Application Data

(60) Provisional application No. 60/282,357, filed on Apr. 26, 2001.

(51) Int. Cl.[7] ..... A63B 53/04

(52) U.S. Cl. ..... 473/245; 473/246; 473/248; 473/290; 473/309; 473/311; 473/314; 473/409

(58) Field of Search ..... 473/245, 246, 473/248, 305, 309, 310, 311, 314, 315, 409, 290; D21/734

(56) References Cited

U.S. PATENT DOCUMENTS

| | | | | |
|---|---|---|---|---|
| 1,426,202 A | | 8/1922 | Lard | |
| 1,540,559 A | | 6/1925 | Murphy | |
| 1,818,359 A | | 8/1931 | Samaras et al. | |
| 1,895,417 A | * | 1/1933 | Lard | 473/310 |
| 2,001,342 A | | 5/1935 | Dyce | |
| 2,027,452 A | | 1/1936 | Rusing | |
| 2,067,556 A | | 1/1937 | Wettlaufer | |
| 2,219,670 A | | 10/1940 | Wettlaufer | |
| 2,326,495 A | | 8/1943 | Reenstierna | |
| 2,425,808 A | | 8/1947 | Jakosky | |
| 2,708,579 A | | 5/1955 | Hugman | |
| 3,909,005 A | | 9/1975 | Piszel | |
| 3,980,301 A | | 9/1976 | Smith | |
| 4,892,316 A | | 1/1990 | Langert et al. | |

(List continued on next page.)

FOREIGN PATENT DOCUMENTS

| | | |
|---|---|---|
| GB | 2207358 A | 2/1988 |
| GB | 2241173 A | 8/1991 |
| GB | 2332150 A | 6/1999 |
| TW | 78209008 | 8/1990 |

OTHER PUBLICATIONS

Donahue, Steve, "Finding the Right Fit," *Golf Shop Operations*, May 1997, pp. 27–32.

"Dynamic Lie," *Golf Tips*, Mar. 1998, pp. 69, 70, 90–92.

Pro Shop John, "Interview—Ping's John Solheim," *www.golfonline.com*, Feb. 5, 1998.

Gazze, Shannon, "Tour of Ping Plant Proves Educational," *www.golfarizona.com*, Oct. 26, 1999.

"Ping to Introduce Custom–Fit Stainless steel i3 Driverz—Another Golf Industry First," *www.hoover'sonline,com*, Nov. 17, 2000.

Ping Press REelease from Bob Cantin, Director of Communications, Dec. 11, 1997, "New Ping ISI Titanium (TiSi) Largest Custom–Fit Driver in Industry."

*Primary Examiner*—Stephen Blau

(74) *Attorney, Agent, or Firm*—Wong, Cabello, Lutsch, Rutherford & Brucculeri, LLP

(57) ABSTRACT

A shot control hosel is disclosed for customizing golf clubs. The disclosed embodiments of the invention provide a set of hosels, each hosel having a conical body. The body has a central axis, a top portion and a bottom portion. A cylindrical opening extends from the top portion to the bottom portion and is adapted to accommodate a golf club shaft. A flange may be provided on the body and may be adapted to engage a notch within a bore of a golf club head. A resilient barb on the smaller of the top portion and the bottom portion is provided to secure the hosel within the bore.

25 Claims, 4 Drawing Sheets

U.S. PATENT DOCUMENTS

| | | | | | |
|---|---|---|---|---|---|
| 4,895,368 | A | | 1/1990 | Geiger | |
| 4,943,059 | A | | 7/1990 | Morell | |
| 4,948,132 | A | | 8/1990 | Wharton | |
| 4,984,794 | A | | 1/1991 | Pernelle et al. | |
| 5,232,224 | A | | 8/1993 | Zeider | |
| 5,335,909 | A | | 8/1994 | Green, Jr. | |
| 5,511,779 | A | | 4/1996 | Meyers et al. | |
| 5,513,844 | A | | 5/1996 | Ashcraft et al. | |
| 5,538,246 | A | | 7/1996 | Dekura | |
| 5,542,666 | A | | 8/1996 | Chou | |
| 5,624,330 | A | * | 4/1997 | Tsuchida | 473/308 |
| 5,626,528 | A | | 5/1997 | Toulon | |
| 5,711,719 | A | * | 1/1998 | Fireman | 473/251 |
| 5,788,585 | A | | 8/1998 | Jackson | |
| 5,839,973 | A | | 11/1998 | Jackson | |
| 5,851,155 | A | | 12/1998 | Wood et al. | |
| 5,906,549 | A | | 5/1999 | Kubica | |
| 5,938,541 | A | | 8/1999 | Allen et al. | |
| 5,951,411 | A | | 9/1999 | Wood et al. | |
| 6,273,828 | B1 | | 8/2001 | Wood et al. | |

* cited by examiner 41a
41b

SHOT CONTROL HOSEL

RELATED APPLICATION

This application is related to, and claims priority under 35 U.S.C. §119(e) of, U.S. provisional application Serial No. 60/282,357, titled "SHOT CONTROL HOSEL", filed Apr. 6, 2001, which is hereby incorporated by reference in its entirety.

BACKGROUND OF THE INVENTION

1. Field of the Invention

The present invention relates generally to golf club hosels. In particular, the invention relates to shot control hosels.

2. Related Art

The information contained in this section relates to the background of the art of the present invention without any admission as to whether or not it legally constitutes prior art.

Many types and kinds of adjustable hosels are available for golf clubs. Reference may be made to the following U.S. Pat. No. 5,788,585 to Jackson, U.S. Pat. No. 5,839,973 to Jackson, U.S. Pat. No. 5,851,155 to Wood et al., U.S. Pat. No. 5,906,549 to Kubica, U.S. Pat. No. 5,951,411 to Wood et al., and U.S. Pat. No. 6,273,828 B1 to Wood et al. Further, reference may be made to UK patent document number 2,207,358A and to Taiwan patent document number 78,209,008.

BRIEF DESCRIPTION OF THE DRAWINGS

In the following, the invention will be explained in further detail with reference to the drawings, in which.

DESCRIPTION OF CERTAIN EMBODIMENTS OF THE INVENTION

The present invention provides a system and a method for customizing golf clubs. In particular, the disclosed embodiments of the present invention relate to interchangeable hosels for golf clubs.

In one embodiment, a set of hosels is provided, each hosel having a conical body, the body having a central axis, a top portion and a bottom portion; a cylindrical opening extending from the top portion to the bottom portion, the opening being adapted to accommodate a golf club shaft; a flange adapted to engage a notch within a bore of a golf club head; and a resilient barb on a smaller one of the top portion and the bottom portion, the barb being larger than the smaller one of the top portion and the bottom portion.

One embodiment of the present invention relates to a hosel which may be made from non-metallic substances such as thermoplastic material or other.

Figure 1:
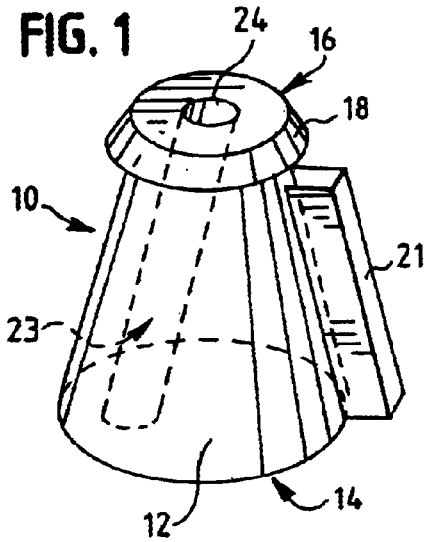
FIG. 1 is a pictorial view of one embodiment of a hosel according to the invention.

FIG. 1 is a pictorial view of one embodiment of a hosel for a golf-club assembly according to the invention. The illustrated hosel 10 has a conical body 12 with a bottom portion 14 being larger than a top portion 16. The conical body 12 of the hosel may be made of a lighter material such as plastic to provide reduced weight of the golf club assembly, though metallic substances and other substances such as resins, may also be used. The top portion 16 is provided with an annular barb 18 for providing a one-way fit, as described below with reference to FIG. 6. The conical body 12 of the hosel 10 is provided with a radial flange 21 extending axially along one portion of the conical body 12. The flange 21 extends through substantially the entire length of the conical body 12 and provides a non-rotating fit of the hosel 10 with a golf club.

Although FIG. 1 illustrates a hosel 10 having the shape of a cone which is generally circular in cross-section, it is understood that many other cross-sectional shapes may also be used. Some such alternatives are illustrated in FIG. 10 and are described below. It is noted that some of the shapes do not require a flange, such as flange 21 of FIG. 1, since the shapes themselves may provide a non-rotating fit.

Referring again to FIG. 1, the hosel 10 is also provided with a shaft-receiving opening 23 that extends from the top 16 of the hosel 10 at a pivot point 24 to substantially the bottom 14 of the hosel 10. The opening 23 is sized to receive a shaft therein and to retain therein through frictional force and/or a suitable adhesive or other suitable technique. The opening 23 is in the form in cross-section of a generally straight cylindrical channel. FIG. 1 illustrates a circular cylindrical channel, which is generally circular in cross-section throughout its length. Other cylindrical shapes, such as a cylinder of rectangular cross-section, may be used to provide a more secure non-rotating fit between the shaft and the hosel 10.

The angle and direction at which the opening extends from the pivot point 24 may be adjusted to customize the golf club assembly for each individual golfer. The angle and direction may be adjusted in all three physical dimensions. For example, the shaft may be inserted in a direction that is at one variable angle in a first plane formed by the shaft and the club head, at another variable angle in a vertical plane perpendicular to the first plane, and at a third variable rotation angle. Thus, a plurality of hosels 10 may be made available, with each offering a different longitudinal angle, such as the face angle, and a different lie angle.

The beginning of the opening 23 at the pivot point 24 may be located substantially at the center of the top portion 16 and the center of the annular barb 18. Alternatively, the beginning of the opening 23 may be located near the perimeter of the top portion 16. In this manner, a maximum range of angles may be achieved.

Figure 2A:
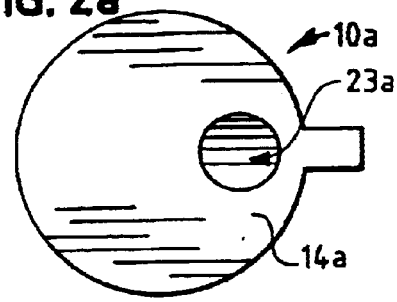
FIG. 2*a* is a bottom face view of the hosel of FIG. 1.
Figure 2B:
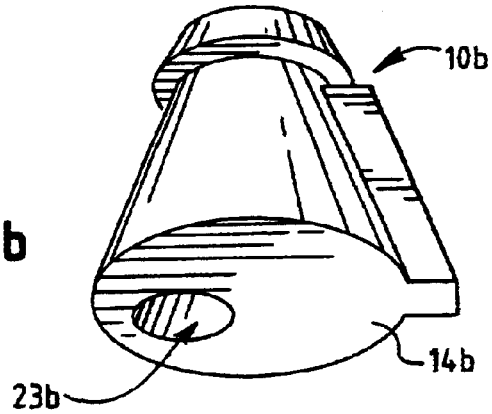
FIG. 2*b* is a bottom pictorial view of the hosel of FIG. 1.

FIGS. 2*a* and 2*b* are bottom views of two exemplary hosels and further illustrate the construction of hosels according to other embodiments of the invention. As noted in the two hosels 10*a* and 10*b* in FIGS. 2*a* and 2*b*, respectively, the opening 23*a*, 23*b* terminates at a different point at the bottom 14*a*, 14*b* of each hosel 10*a*, 10*b* depending on the angle and direction at which the opening extends from the pivot point. Similarly, a different termination point is achieved for each selected angle and direction.

Figure 3A:
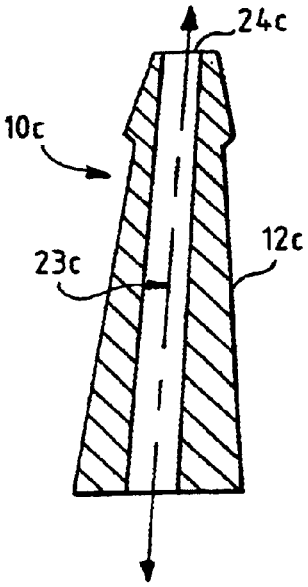
FIGS. 3*a–c* are cross-sectional views of other embodiments of hosels according to the present invention.
Figure 3B:
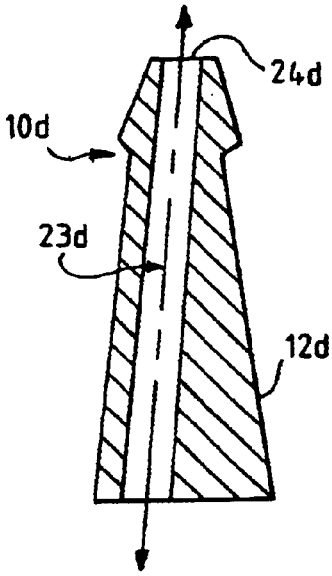
Figure 3C:
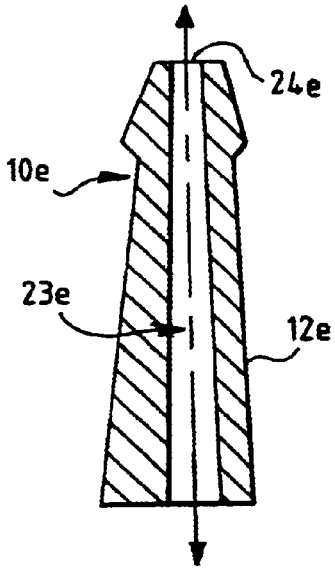

FIGS. 3*a–c* show cross-sectional views of three different hosels 10*c*, 10*d*, 10*e*, respectively, each having an opening 23*c*, 23*d*, 23*e* extending at a different angle from the pivot point 24*c*, 24*d*, 24*e*, respectively. As a result of the varying angle and direction, an axis of the opening 23*c*, 23*d*, 23*e* is not necessarily parallel to a central axis of the hosel body 12*c*, 12*d*, 12*e*, respectively. Thus, an angle ranging between 0° and a predetermined maximum angle may be achieved in any direction between the axis of the opening 23*c*, 23*d*, 23*e* and the central axis of the hosel body 12*c*, 12*d*, 12*e*, respectively.

Although FIGS. 3*a–c* illustrate the angle varying within the cross-sectional plane, it is understood from the description above that the angle may also be varied in the plane perpendicular to the cross-sectional plane.

Figure 4:
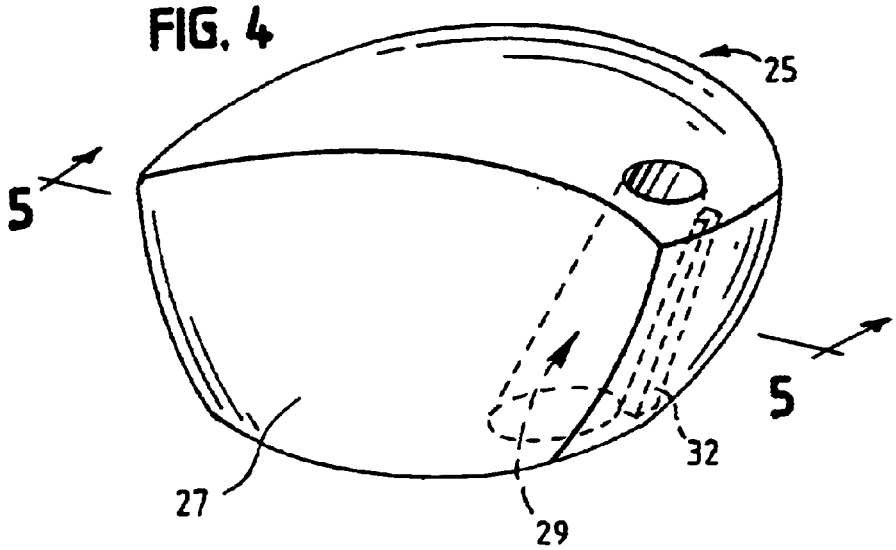
FIG. 4 is a pictorial view of a golf club incorporating the hosel of FIG. 1.

FIG. 4 illustrates a golf club head 25 for a golf club assembly adapted to receive a hosel, such as the hosels described above with reference to FIGS. 1, 3*a*, 3*b* and 3*c*. The golf club head 25 has a face 27 for striking a golf ball. The head 25 is provided with a bore 29 extending from the top to the bottom of the head 25. The bore 29 is sized and shaped to receive the conical body 12 of the hosel 10. The bore 29 is also provided with a notch 32 sized to receive the flange 21 of the hosel 10 described above. As noted above, it is understood that hosels of certain shapes do not require a flange. Accordingly, the bore 29 of the club head 25 may also lack the notch 32.

Figure 5:
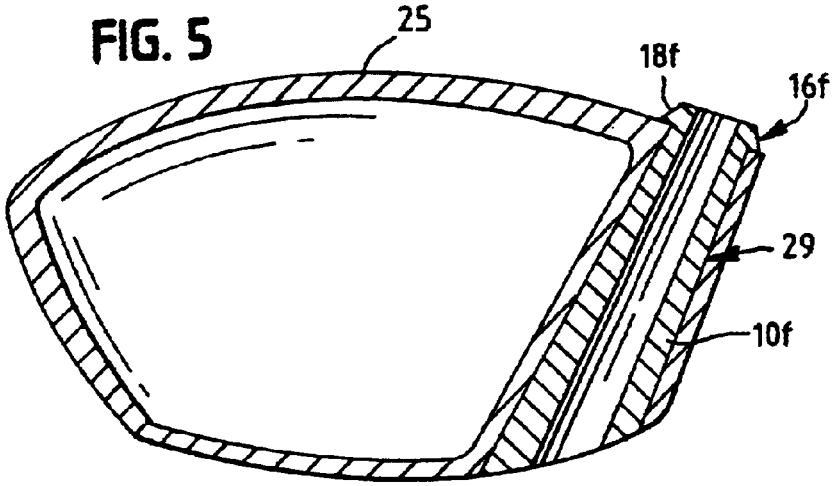
FIG. 5 is a cross-sectional side view of the assembled golf club illustrated in FIG. 4.
Figure 6:
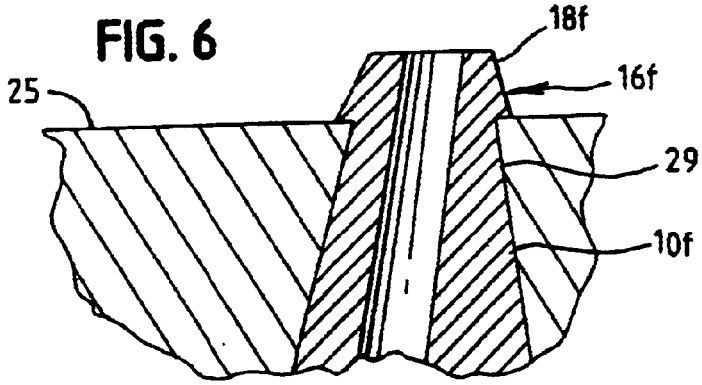
FIG. 6 is a cross-sectional view of the engagement of another embodiment of a hosel forming a golf club.
Figure 7:
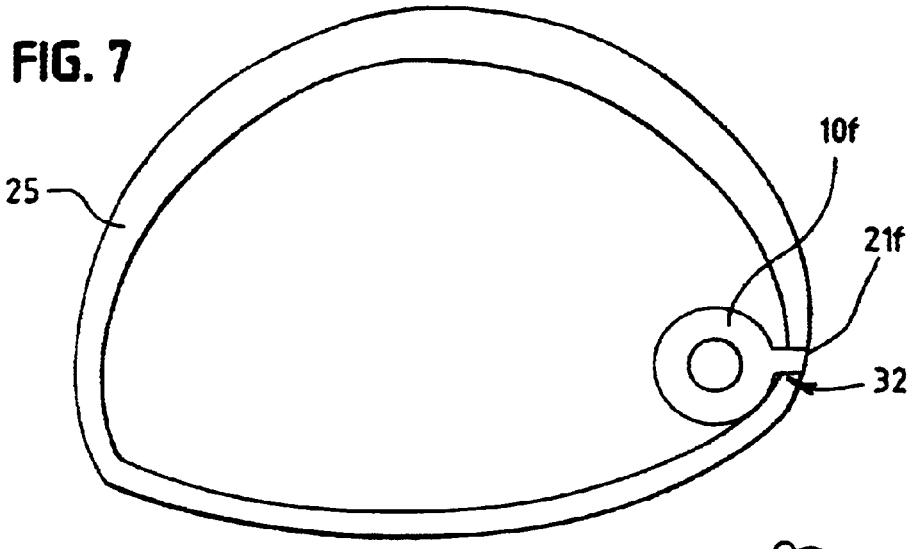
FIG. 7 is a bottom view of a golf club head with another embodiment of a hosel assembled thereto.

FIG. 5–7 illustrate the engagement of a hosel 10*f*, similar to the hosels described above with reference to FIGS. 1–3*c*, with the golf club head 25. The top 16*f* of the hosel 10*f* may be inserted into the bore 29 from the bottom of the head 25 with the flange 21*f* aligned with the notch 32. Thus, the hosel 10*f* may be inserted through the larger opening of the bore 29 with the smaller, top portion 16*f* of the hosel 10*f* leading. The hosel 10*f* may be forced into the bore until the annular barb 18*f* emerges through the other end of the bore 29 at the top of the golf club head 25. Once the barb 18*f* emerges completely out of the bore 29, as illustrated in FIG. 6, the hosel 10*f* may be securely retained within the bore 29. The barb 18*f* prevents the hosel 10*f* from becoming disengaged with the club head 25 by preventing movement of the hosel 10*f* downward relative to the head 25, while the conical fit of the hosel 10*f* prevents further upward movement. Additionally, the flange 21*f* engages the notch 32 to prevent rotation of the hosel 10*f* within the bore 29 of the club head 25. A suitable adhesive may additionally be used to more securely engage the hosel 10*f* with the club head 25. As illustrated in FIG. 7, the illustrated embodiment of the club head assembly may be provided with an open heel. The flange 21*f* of the hosel 10*f* may be flush with the heel of the club head 25 and may be visible from the outside. It is understood, however, that the flange 21*f* may be contained completely within the club head 25.

It is understood that although the illustrated embodiments illustrate a conical hosel body with a larger bottom portion and a small top portion engaging a club head bore with corresponding dimensions, other embodiments of the invention may provide hosels with larger top portions and smaller bottom portions for engaging a club head bore with the appropriate dimensions.

Figure 8:
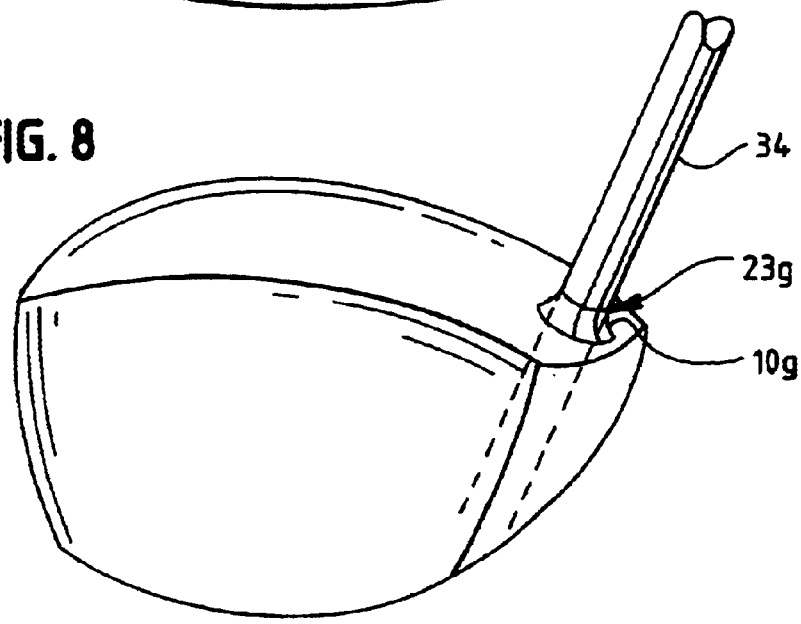
FIG. 8 is a fragmentary pictorial view of an assembled golf club incorporating the hosel of FIG. 1 with the club shaft assembled to the hosel.
Figure 9:
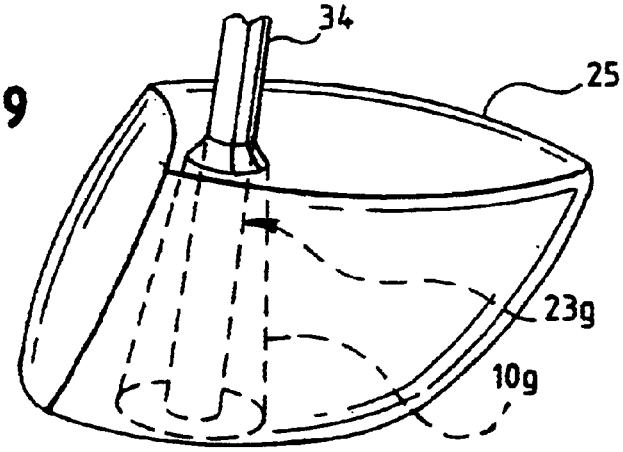
FIG. 9 is a diagrammatic back view of an embodiment of a golf club assembly using a further embodiment of a hosel according to another embodiment of the invention.

FIGS. 8 and 9 illustrate a golf club assembly using a hosel 10*g*, similar to the hosel 10 described above with reference to FIG. 1, with a shaft 34 inserted into the opening 23*g* of the hosel 10*g*. The opening 23*g* of the hosel 10*g* receives a shaft 34 (shown partially cut away in FIG. 9) of the golf club. The shaft 34 may be secured within the opening 23*g* by one of several mechanisms including, for example, frictional force and a suitable adhesive. The shaft 34 extends from the club head 25 at an angle and a direction determined by the angle and direction of the opening 23*g* within the hosel 10*g*. Thus, the position of the shaft 34 relative to the club head 25 may be customized for a particular golfer by selecting a hosel 10*g* with the appropriate opening 23*g* angle and direction.

When the golf club is assembled by using a selected one of a plurality of hosels, each having a varying angle and direction between the opening and the hosel body. Alternatively, the plurality of hosels may be provided with angles varying in the above noted three dimensions. Thus, a golfer may select a golf club and then select the hosel which provides the desired club head orientation.

Figures 10A, 10B, 10C, 10D, 10E, 10F, 10G, 10H, 10I, 10J, 10K, 10L, 10M, 10N, 10O, 10P, 10Q, 10R:
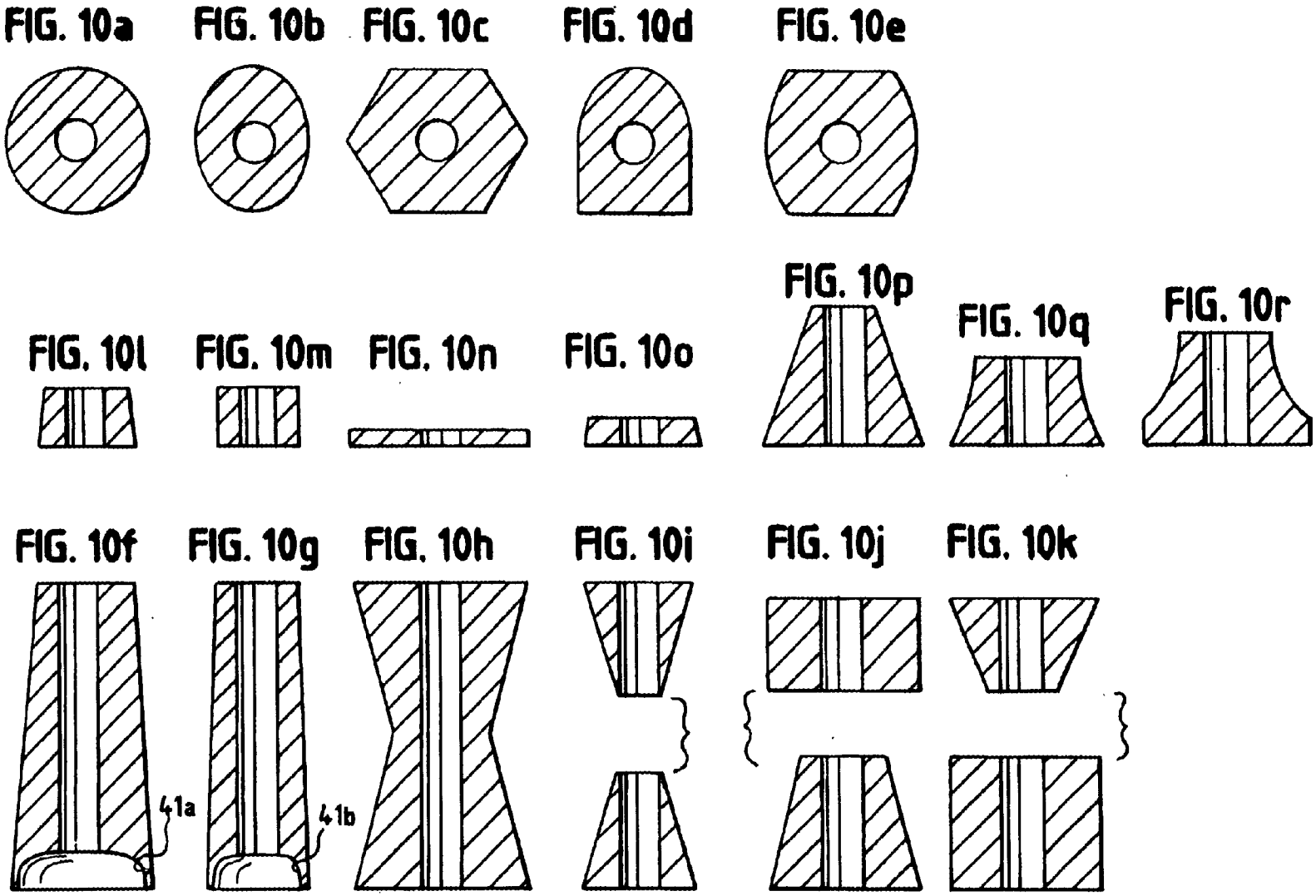
FIGS. 10*a–r* illustrate a variety of other embodiments of the present invention.

FIGS. 10*a–r* illustrate certain other embodiments of a hosel according to the invention. FIGS. 10*a–e* illustrate cross-sectional views taken along a plane parallel to the bottom and top surfaces of the hosels. As noted above, the hosel body need not be a circular cone with a flange. The bottom views illustrated in FIGS. 10*a–e* indicate that the cross section of the hosel may be a circle without a flange (FIG. 10*a*), an oval (FIG. 10*b*), a hexagon (FIG. 10*c*), irregular (FIG. 10*d*), or rectangular (FIG. 10*e*) in shape. Other shapes may also be used. As indicated above, with the non-circular shapes, such as those illustrated in FIGS. 10*b–e*, the hosel does not require a flange to provide a non-rotating fit between the hosel and the club head. The embodiment illustrated in FIG. 10*a* may be provided with an adhesive for preventing rotation.

FIGS. 10*f–k* illustrate cross-sectional views taken along a vertical plane of various other embodiments of hosels according to the present invention. Some of these embodiments, such as those illustrated in FIGS. 10*f* and 10*g*, may provide that the hosel comprise a recess, such as recess 41*a*, 41*b*, near the bottom portion to further reduce the weight of the golf club. Still other embodiments, such as those illustrated in FIGS. 10*h–*10*k*, may provide hosels comprising a multiple-component body. For example, FIG. 10 illustrates a hosel having two conical elements. Each element may be inserted from opposite ends of a bore in a club head, resulting in the smaller top portions of the two elements abutting in the middle of the bore. Of course, the bore in the club head is shaped to accommodate the particular shape of the hosel. The two elements may be secured in place with adhesive, for example. Similarly, FIGS. 10*i–k* illustrate multiple-component hosel bodies adapted to be inserted from opposite ends of the bore. As apparent from FIGS. 10*i–k*, the components of the multiple-component bodies need not be identical.

FIGS. 10*l–r* illustrate cross-sectional views taken along a vertical plane of the barb portions of various other embodiments of hosels according to the present invention. The barbs may be provided in either the top or the bottom of a hosel body. For multiple-component hosel bodies, a barb may be provided on one end of each component.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. A golf club customizing system, comprising:
   a plurality of hosels, each hosel comprising:
   a conical body, said body having a central axis, a top portion and a bottom portion;
   a golf club shaft-receiving opening extending from said top portion toward said bottom portion, said opening having an opening axis;
   a flange adapted to engage a notch within a bore of a golf club head; and
   a resilient barb mounted onto a smaller one of said top portion and said bottom portion, said barb being larger than the smaller one of the top portion and the bottom portion.

2. The system according to claim 1, wherein said golf club shaft-receiving opening is cylindrical.

3. The system according to claim 1, wherein said opening axis forms an angle in a direction with said central axis of said conical body.

4. The system according to claim 3, wherein at least one of said angle and said direction are different for each hosel of said plurality of hosels.

5. The system according to claim 1, wherein said opening axis and said central axis form an angle associated with a face angle.

6. The system according to claim 1, wherein said opening axis and said central axis form an angle associated with a lie angle.

7. The system according to claim 1, wherein said conical body comprises a cross-section having a circular shape.

8. The system according to claim 1, wherein said conical body comprises a cross-section having a non-circular shape.

9. The system according to claim 1, wherein said opening comprises a circular cylinder.

10. The system according to claim 1, wherein said opening comprises a non-circular cylinder.

11. A method of customizing golf clubs, comprising:
   providing a plurality of hosels, each hosel comprising:
   a conical body, said body having a central axis, a top portion and a bottom portion;
   a golf-club shaft-receiving opening extending from said top portion toward said bottom portion, said opening having an opening axis.
   a flange adapted to engage a notch within a bore of a golf club head; and
   a resilient barb mounted onto a smaller one of said top portion and said bottom portion, said barb being larger than the smaller one of the top portion and the bottom portion,
   each hosel of said plurality of hosels having a different combination of an angle and a direction between said central axis and said opening axis; and
   selecting one hosel from said plurality of hosels, said one hosel having a combination of said angle and said direction adapted to provide a desired orientation of a club head relative to a club shaft.

12. The method according to claim 11, wherein said shaft-receiving opening is cylindrical.

13. The method according to claim 11, wherein said selected one hosel provides a desired face angle.

14. The method according to claim 11, wherein said selected one hosel provides a desired lie angle.

15. A golf club customizing system, comprising:
   a plurality of hosels, each hosel comprising:
   a body, said body having a central axis, a top portion and a bottom portion;
   a golf club shaft-receiving opening extending from the top portion toward the bottom portion, said opening having an opening axis; and
   a resilient barb mounted onto a smaller one of said top portion and said bottom portion, said barb being larger than the smaller one of the top portion and the bottom portion;
   wherein said body comprises a section of a cone.

16. The system according to claim 15, wherein each hosel further comprises a flange on said body and adapted to engage a notch within a bore of a golf club head.

17. The system according to claim 15, wherein said opening is cylindrical.

18. The system according to claim 15, wherein said opening axis forms an angle in a direction with the central axis of said body.

19. The system according to claim 18, wherein at least one of the angle and the direction are different for each hosel of said plurality of hosels.

20. The system according to claim 15, wherein the opening axis and the central axis form an angle associated with a face angle.

21. The system according to claim 15, wherein the opening axis and the central axis form an angle associated with a lie angle.

22. The system according to claim 15, wherein said body comprises a cross-section having a circular shape.

23. The system according to claim 15, wherein said body comprises a cross-section having a non-circular shape.

24. The system according to claim 15, wherein said opening comprises a circular cylinder.

25. The system according to claim 15, wherein said opening comprises a non-circular shape.

* * * * *